US008944311B2

(12) United States Patent
Dougherty et al.

(10) Patent No.: US 8,944,311 B2
(45) Date of Patent: Feb. 3, 2015

(54) DISPLAY BIN

(75) Inventors: Kristin A. Dougherty, Chaska, MN (US); Laura L. Hawkins, Minneapolis, MN (US); Leslie E. Miehe, Elk River, MN (US)

(73) Assignee: Target Brands, Inc., Minneapolis, MN (US)

( * ) Notice: Subject to any disclaimer, the term of this patent is extended or adjusted under 35 U.S.C. 154(b) by 161 days.

(21) Appl. No.: 13/472,196

(22) Filed: May 15, 2012

(65) Prior Publication Data

US 2013/0306516 A1 Nov. 21, 2013

(51) Int. Cl.
*B65D 3/00* (2006.01)
*B65D 25/54* (2006.01)

(52) U.S. Cl.
USPC ..... 229/4.5; 206/769

(58) Field of Classification Search
USPC ..... 211/85.18; 220/23.4, 23.83, 23.86, 220/23.88, 507, 23.89; 206/736, 769–771; 229/125.28, 125.38, 116.1, 4.5, 162.1
See application file for complete search history.

(56) References Cited

U.S. PATENT DOCUMENTS

| | | | | |
|---|---|---|---|---|
| 105,269 | A | 7/1870 | Spencer | |
| 265,836 | A | 10/1882 | Lindner | |
| 333,643 | A | 1/1886 | Lewis | |
| 672,282 | A * | 4/1901 | Munford | 220/4.09 |
| 979,261 | A | 12/1910 | Compton | |
| 1,113,350 | A | 10/1914 | Inman | |
| 2,016,863 | A * | 10/1935 | La Grua | 229/5.5 |
| 2,022,601 | A | 11/1935 | McDonald | |
| 2,080,105 | A | 5/1937 | Bacon | |
| D106,202 | S | 9/1937 | Kane | |
| 2,275,542 | A | 3/1942 | Menges | |
| 2,329,605 | A | 9/1943 | Gladstein | |
| 2,340,373 | A | 2/1944 | Gardner | |
| 2,458,578 | A | 1/1949 | Evans | |
| 2,540,707 | A | 2/1951 | Beukelman | |
| 2,713,740 | A | 7/1955 | Fessenden et al. | |
| 3,305,161 | A | 2/1967 | Offer | |
| 3,313,333 | A | 4/1967 | Lordi | |
| 3,330,405 | A | 7/1967 | Taub | |
| 3,370,773 | A | 2/1968 | Mayo | |
| 3,406,816 | A | 10/1968 | Green et al. | |
| D237,001 | S | 9/1975 | Von Serda | |
| D244,259 | S | 5/1977 | Bergstein | |

(Continued)

FOREIGN PATENT DOCUMENTS

CA 2406491 A1 1/2003

OTHER PUBLICATIONS

Office Action from Canadian Patent Application No. 2,794,152, mailed Aug. 13, 2013 (6 pages).

(Continued)

*Primary Examiner* — Patrick Hawn
(74) *Attorney, Agent, or Firm* — Griffiths & Seaton PLLC; JoAnn M. Seaton

(57) ABSTRACT

A display bin includes a tubular body and a multi-part bottom assembly. The tubular body includes an open base end and an open top end. The multi-part bottom assembly includes an annular structure having an inner edge, an outer edge and a plurality of evenly spaced wings projecting outwardly from the outer edge and terminating at distal ends. The annular structure is capable of being inserted through the open base end of the tubular body. A plurality of fasteners couple each of the plurality of wings of the annular structure to the base end of the tubular body.

13 Claims, 13 Drawing Sheets

(56) References Cited

U.S. PATENT DOCUMENTS

| | | | | |
|---|---|---|---|---|
| 4,121,710 | A | 10/1978 | Murphy | |
| 4,415,077 | A * | 11/1983 | Murphy | 220/4.26 |
| D283,592 | S | 4/1986 | Quarrell et al. | |
| 4,628,634 | A * | 12/1986 | Anderson | 47/73 |
| 4,700,847 | A | 10/1987 | Shieh | |
| 4,775,093 | A * | 10/1988 | Lin | 229/117.25 |
| 4,846,394 | A | 7/1989 | Swanson | |
| 5,031,826 | A | 7/1991 | Seufert | |
| 5,052,570 | A | 10/1991 | Johansen | |
| D327,093 | S | 6/1992 | Evenson | |
| D327,965 | S | 7/1992 | Chelec | |
| D333,025 | S | 2/1993 | Doherty | |
| 5,328,732 | A | 7/1994 | Renna | |
| 5,372,269 | A * | 12/1994 | Sutton et al. | 220/62 |
| D357,886 | S | 5/1995 | Fuller | |
| 5,471,783 | A | 12/1995 | McLean | |
| D376,284 | S | 12/1996 | Keeley | |
| 5,730,352 | A * | 3/1998 | Deekes | 229/4.5 |
| D405,689 | S | 2/1999 | Moon | |
| D411,676 | S | 6/1999 | Cantrell | |
| D413,189 | S | 8/1999 | Conti | |
| D417,616 | S | 12/1999 | Conway | |
| 6,152,359 | A | 11/2000 | Clark | |
| D436,705 | S | 1/2001 | Dow et al. | |
| 6,170,740 | B1 | 1/2001 | Clark | |
| D446,684 | S | 8/2001 | Price | |
| D450,456 | S | 11/2001 | Warren, III | |
| D456,211 | S | 4/2002 | Price | |
| D462,422 | S | 9/2002 | Conner | |
| D466,763 | S | 12/2002 | Wu | |
| D489,501 | S | 5/2004 | Dretzka | |
| D495,880 | S | 9/2004 | Warren, III | |
| D521,202 | S | 5/2006 | Lin | |
| D525,657 | S | 7/2006 | Warren, III | |
| 7,111,735 | B2 | 9/2006 | Lowry | |
| D536,497 | S | 2/2007 | Chiang | |
| D546,631 | S | 7/2007 | Carey | |
| 7,625,488 | B2 | 12/2009 | Blackburn | |
| D618,021 | S | 6/2010 | Guindi | |
| D625,852 | S | 10/2010 | Franklin | |
| D625,855 | S | 10/2010 | Franklin | |
| D626,866 | S | 11/2010 | Powers | |
| D631,580 | S | 1/2011 | Franklin | |
| D631,581 | S | 1/2011 | Franklin | |
| D632,651 | S | 2/2011 | Foreman et al. | |
| D638,644 | S | 5/2011 | Tawil | |
| D645,779 | S | 9/2011 | Bradley et al. | |
| 2001/0032795 | A1 | 10/2001 | Weinstein et al. | |
| 2002/0185525 | A1 | 12/2002 | Hallam | |
| 2006/0289609 | A1 | 12/2006 | Fritz et al. | |
| 2008/0142397 | A1 * | 6/2008 | Heller et al. | 206/499 |
| 2009/0145953 | A1 | 6/2009 | Heinemann, III et al. | |
| 2009/0200200 | A1 | 8/2009 | Trappani et al. | |
| 2010/0320262 | A1 | 12/2010 | Tao | |
| 2013/0026163 | A1 * | 1/2013 | Hawkins | 220/4.01 |

OTHER PUBLICATIONS

Office Action from Canadian Patent Application No. 2,794,152, mailed Mar. 1, 2013 (4 pages).

* cited by examiner

DISPLAY BIN

BACKGROUND

In retail stores, loose items on display for purchase are placed in bins. These bins can be awkward to transport to a retail store. In addition, the sides of the bins can obscure the items on display for purchase.

The discussion above is merely provided for general background information and is not intended to be used as an aid in determining the scope of the claimed subject matter.

SUMMARY

A display bin includes a tubular body and a multi-part bottom assembly. The tubular body includes an open base end and an open top end. The multi-part bottom assembly includes an annular structure having an inner edge, an outer edge and a plurality of evenly spaced wings projecting outwardly from the outer edge and terminating at distal ends. The annular structure is capable of being inserted through the open base end of the tubular body. A plurality of fasteners couple each of the plurality of wings of the annular structure to the base end of the tubular body.

A method of erecting the display bin is also described and includes rolling the tubular body and securing opposing side ends of the inner sleeve together to form a cylindrical shape. The plurality of wings project from an outer edge of the annular structure and are folded at bend lines such that the distal ends of each wing faces substantially upwards. The plurality of wings are attached to the tubular body by inserting a fastener through each wing and through each opening located proximally to the base end of the tubular body. An insert is inserted through the top end of the tubular body so as to mate the insert with a top surface of the annular structure including the plurality of wings. A diameter of the insert is greater than an inner diameter of the annular structure.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described below include one or more display bins that can be shipped to a retail store in a flattened form and erected at the retail store into one or more display bins for holding loose items. Each display bin includes a transparent plastic tubular body, a band made of opaque sheet material and a multi-part bottom. The multi-part bottom includes an annular structure at least partially formed of corrugated cardboard, an insert made of corrugated cardboard and a plurality of plastic fasteners. During assembly, the tubular body is rolled into a cylinder and secured into shape. The annular structure is attached to a bottom of the tubular body with the plurality of fasteners to provide stability. The insert is then inserted into the cylinder from the top and mates with the bottom annular structure to provide a closed bottom end of the display bin. The band is also rolled into a cylinder and secured into shape. The assembled tubular body, annular structure and insert are together inserted through the center of the band.

Figure 1:
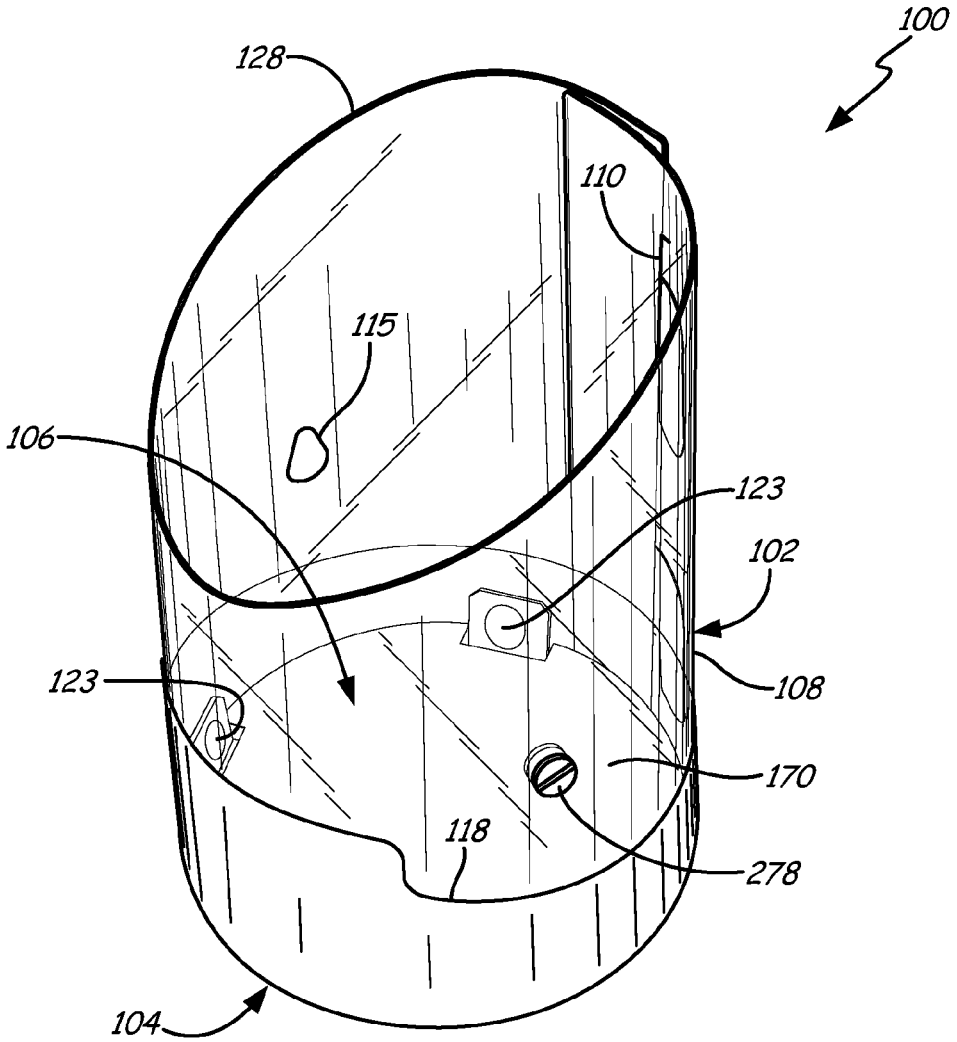
FIG. 1 is a perspective view of a display bin for holding retail products for display according to one embodiment.
Figure 2:
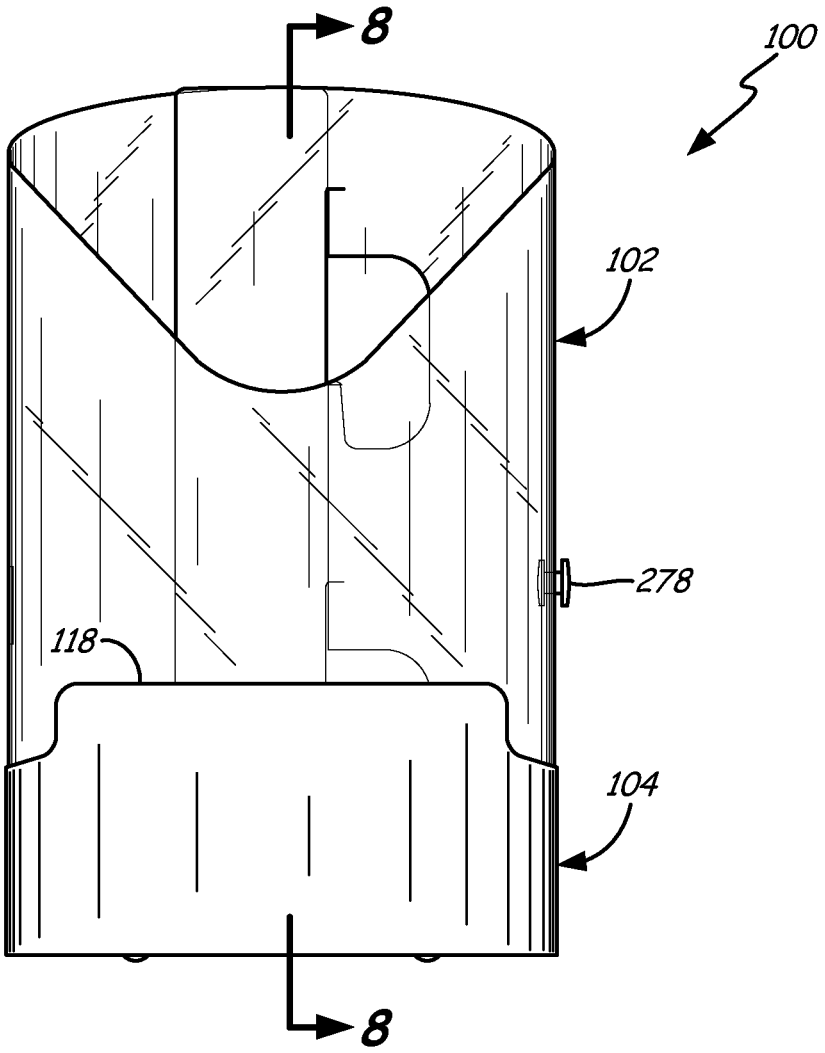
FIG. 2 is a front view of the display bin of FIG. 1.
Figure 3:
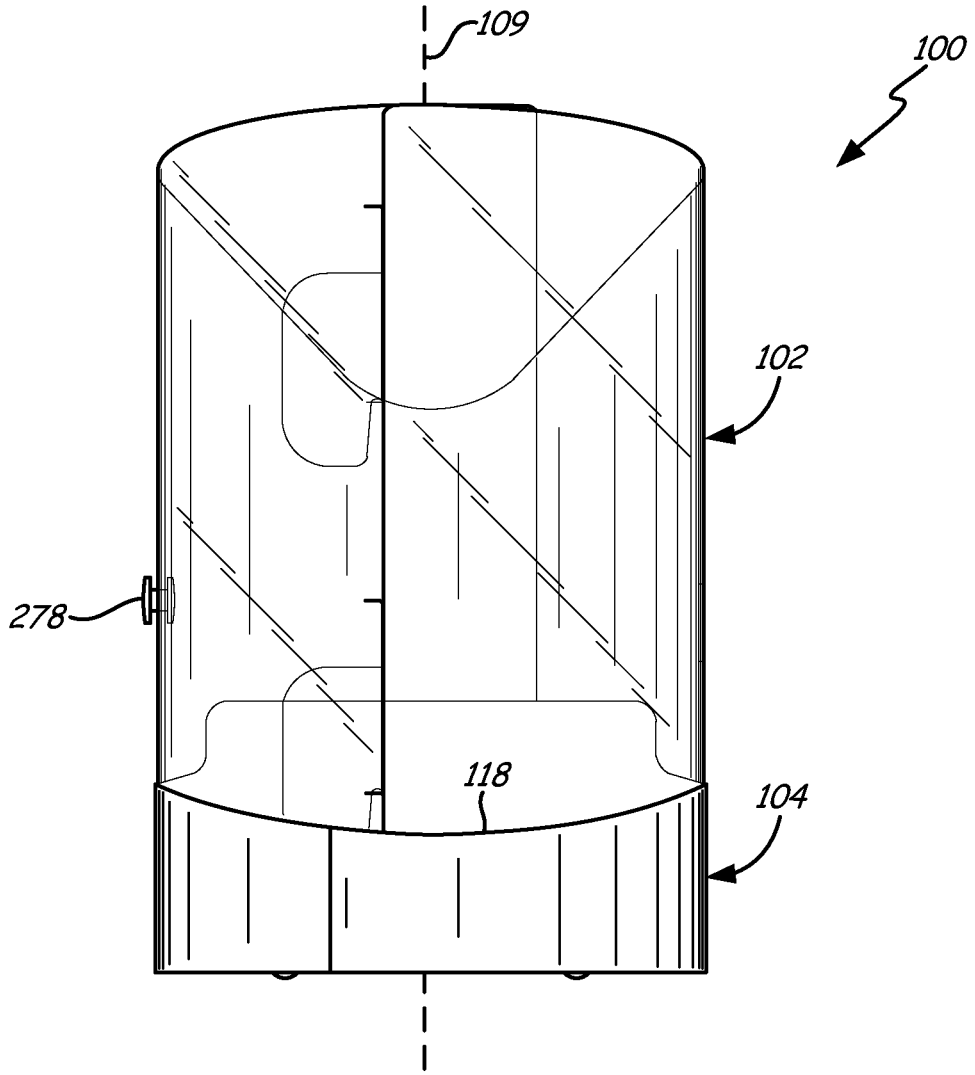
FIG. 3 is a back view of the display bin of FIG. 1.
Figure 8:
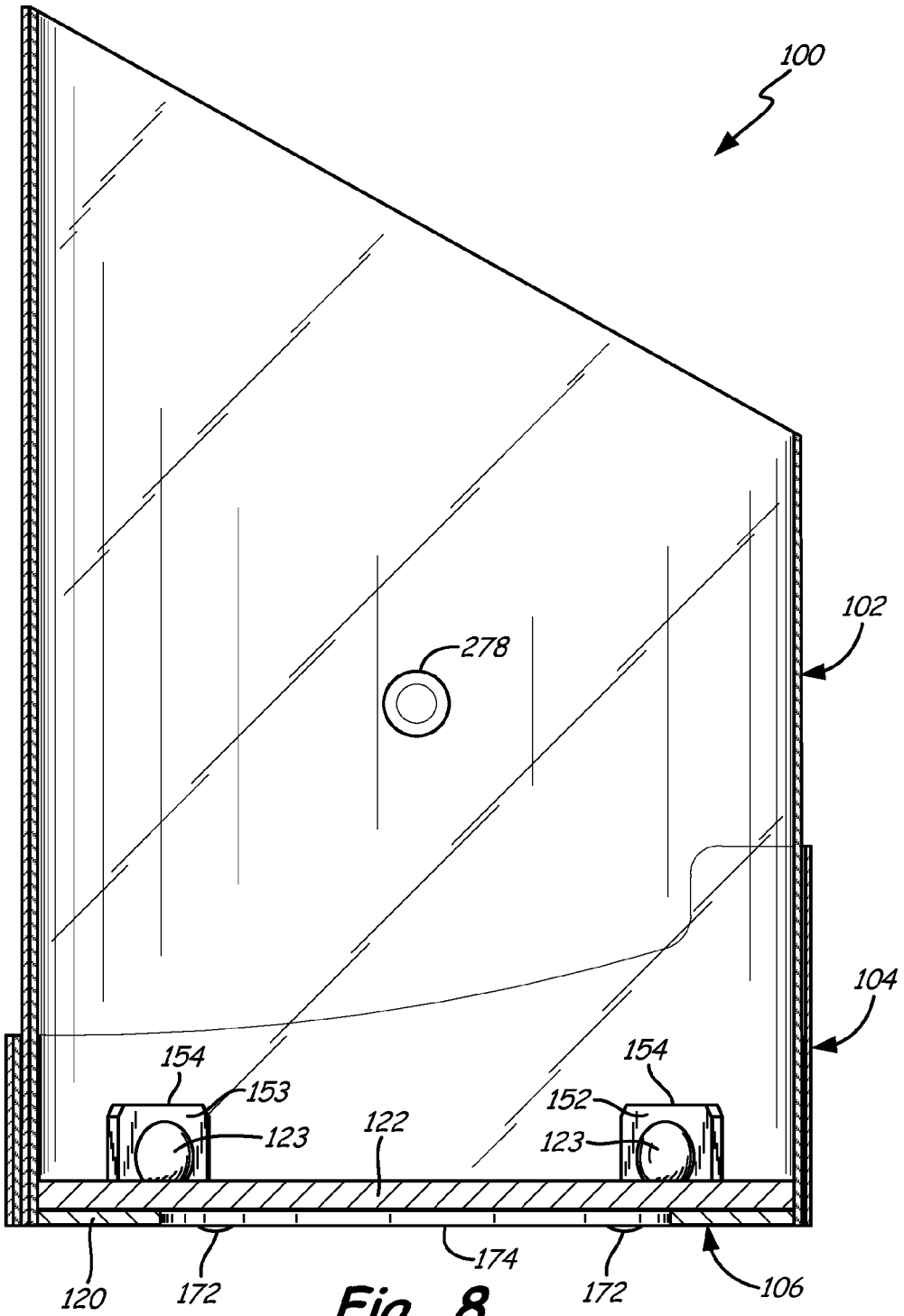
FIG. 8 is a section view of the display bin of FIG. 1.

FIG. 1 is a perspective view of a display bin 100 in an erected state. FIGS. 2-7 illustrate elevation views of erected display bin 100 including a front view, a back view, a top view, a bottom view, a left side view, a right side view, a top view and a bottom view. FIG. 8 illustrates a section view of display bin 100 taken along a section line illustrated in FIG. 2. Herein, the display bin 100 may also be referred to alternatively, as part or all of a retail display unit, a retail display apparatus, or a container.

Figure 4:
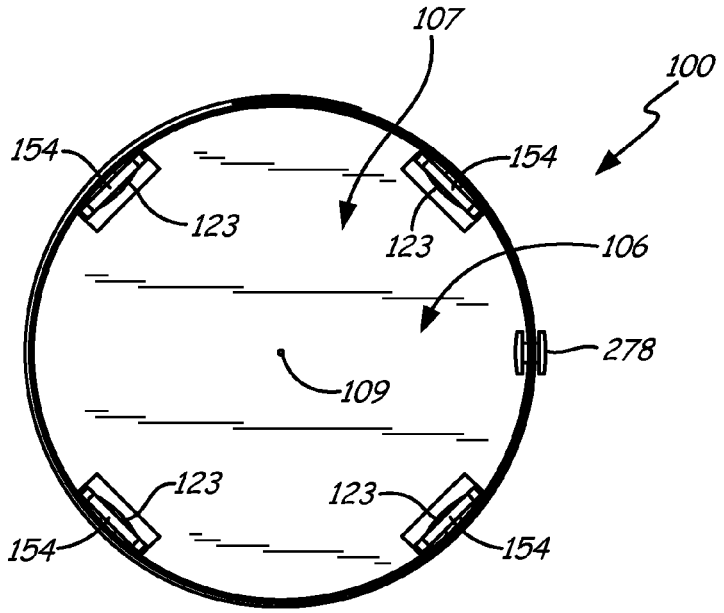
FIG. 4 is a top view of the display bin of FIG. 1.

Display bin 100 includes a tubular body or inner sleeve 102, a band or outer sleeve 104 and a multi-part bottom assembly 106. Band 104 surrounds and is in contact with at least a portion of an outer surface 170 of tubular body 102, which in turn surrounds an open space 107 (FIG. 4). In some embodiments, band 104 is not bonded or attached to tubular body 102 and, therefore, band 104 may be moved relative to tubular body 102 along a central axis 109 (FIG. 4). Multi-part bottom assembly 106 is formed of a plurality of structural components so as to allow display bin 100 to support a heavy load. In one embodiment, display bin 100 can hold a plurality of loose items that are beauty related. For example, one particular kind of beauty item includes liquid-filled trial size bottles. Such liquid-filled trial size bottles, when supported together in a single display bin 100, can provide a significant load, which multi-part bottom assembly 106 is capable of holding with structural integrity.

According to one embodiment, display bin 100 is shipped to a retail store in a flattened state. In particular, tubular body 102 is shipped to the retail store in a sheet material form such as that illustrated in the plan view of FIG. 9 and band 104 is shipped to the retail store in a sheet material form such as that illustrated in the plan view of FIG. 10.

Figure 9:
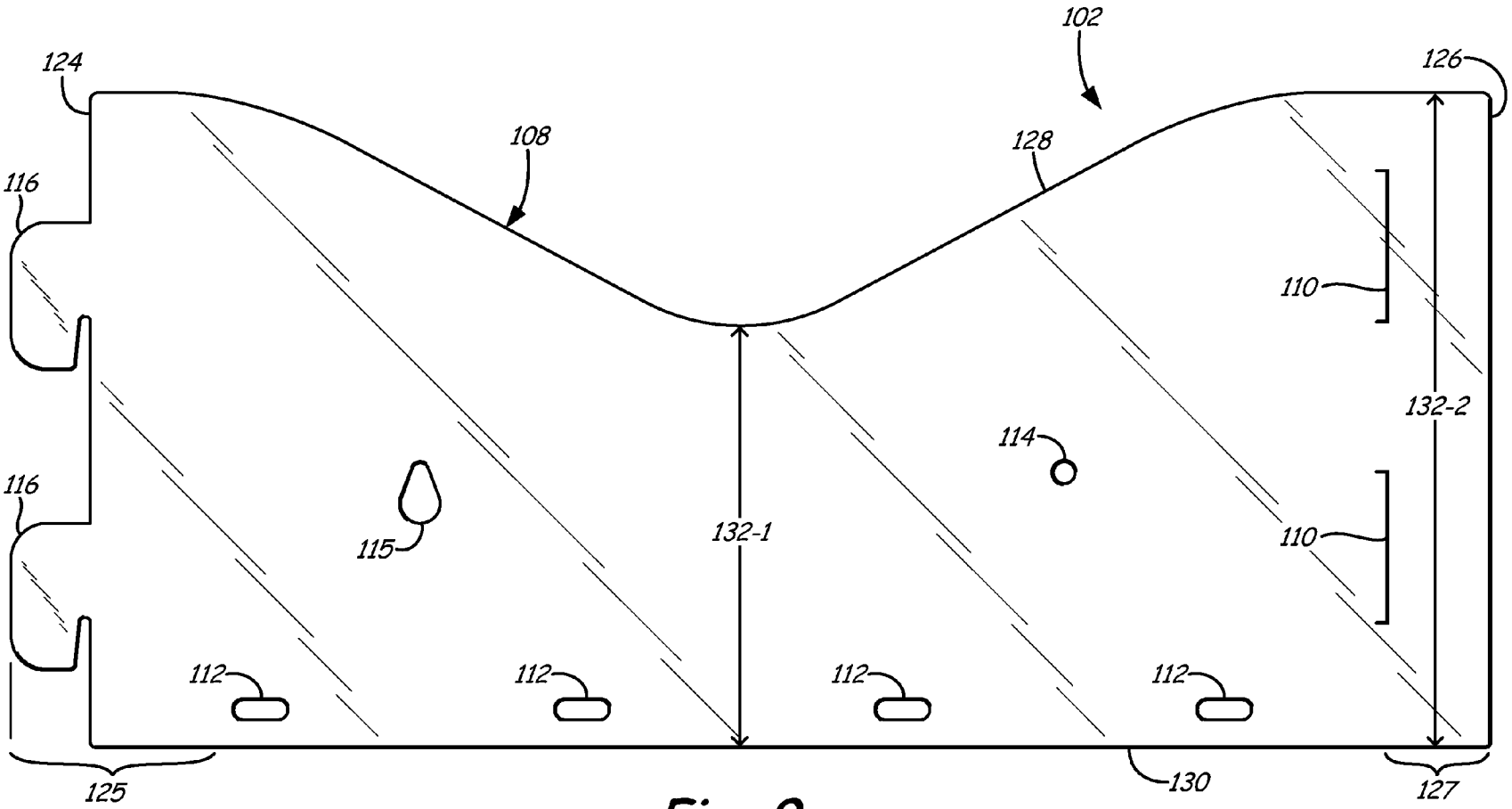
FIG. 9 is a plan view of a tubular body or inner sleeve of the display bin of FIG. 1.

As illustrated in FIG. 9, tubular body 102 is made of a single, continuous and transparent plastic sheet material 108 having a plurality of slits 110, a plurality of openings including base or bottom openings 112 spaced apart from each other and located near or proximal to a base or bottom end 130 of tubular body 102, a first side opening 114 and a second side opening 115 that are located on a respective right side and left side of an assembled tubular body 102. Also formed with the transparent plastic sheet material are a plurality of hooked tabs 116. As shown in the plan view illustrated in FIG. 10, band 104 is made from a single, continuous and fibrous or opaque sheet material 118. As shown in the plan views illustrated in FIGS. 11 and 12 and in the exploded perspective view of FIG. 13, the multi-part bottom assembly 106 includes an annular structure or ring-shaped disk 120 (a first portion), an insert 122 (a second portion) and a plurality of fasteners or rivets 123.

When assembled, tubular body 102 and band 104 have a substantially circular cross-sectional shape; however, according to other embodiments the cross-sectional shape of tubular body 102 and band 104 may be substantially elliptical, substantially oval, or substantially polygonal. In addition, tubular body 102 and band 104 may have irregularities that keep them from having perfectly circular, elliptical, oval or polygonal cross-sectional shapes.

To assemble tubular body 102, transparent plastic sheet material 108 is rolled and opposing side ends 124 and 126 are secured together to form a cylindrical shape having an open top end 128 and an open bottom or base end 130. To secure opposing side ends 124 and 126 together, a first overlapping region 125 of tubular body 102 that extends from first side end 124 is attached to, adhered or bonded to a second overlapping region 127 that extends from the second side end 126. For example, but not limited to, first overlapping region 125 includes the plurality of hooked tabs 116, which are each inserted into one of the plurality of slits 110 that are defined in second overlapping region 127.

As illustrated in FIG. 9, open top end 128 is shaped differently from bottom end 130. In particular, open top end 128 has a non-linear edge, while open bottom end 130 has a substantially linear edge that resides in a single plane and is substantially orthogonal to side ends 124 and 126. Because top end 128 has a non-linear edge, a height 132 of tubular body 102 changes along its circumference when the tubular body 102 is assembled into its cylindrical shape. For example, at a minimum point along tubular body 102, the tubular body includes a minimum height 132-1 and at a maximum point along tubular body 102, tubular body 102 includes a maximum height 132-2. As illustrated, the height of tubular body 102 at any point along its circumference may be any value that is between minimum height 132-1 and maximum height 132-2. In other embodiments, top end 128 can have a linear edge that resides in a single plane that is substantially orthogonal to side ends 124 and 125. In such an embodiment, tubular body 102 has a single height that is constant along its circumference.

To assemble band 104, the fibrous opaque sheet material 118 is rolled and opposing side ends 134 and 136 are secured together to form a cylindrical shape having an open top end 138 and an open bottom end 140. To secure opposing side ends 134 and 136 together, a first overlapping region 135 of tubular body 102 that extends from first side end 134 is attached to, adhered or bonded to a second overlapping region 137 that extends from a second side end 136. For example, but not limited to, first overlapping region 135 or second overlapping region 137 can include an adhesive for securing first end 134 to second end 136.

Figure 10:
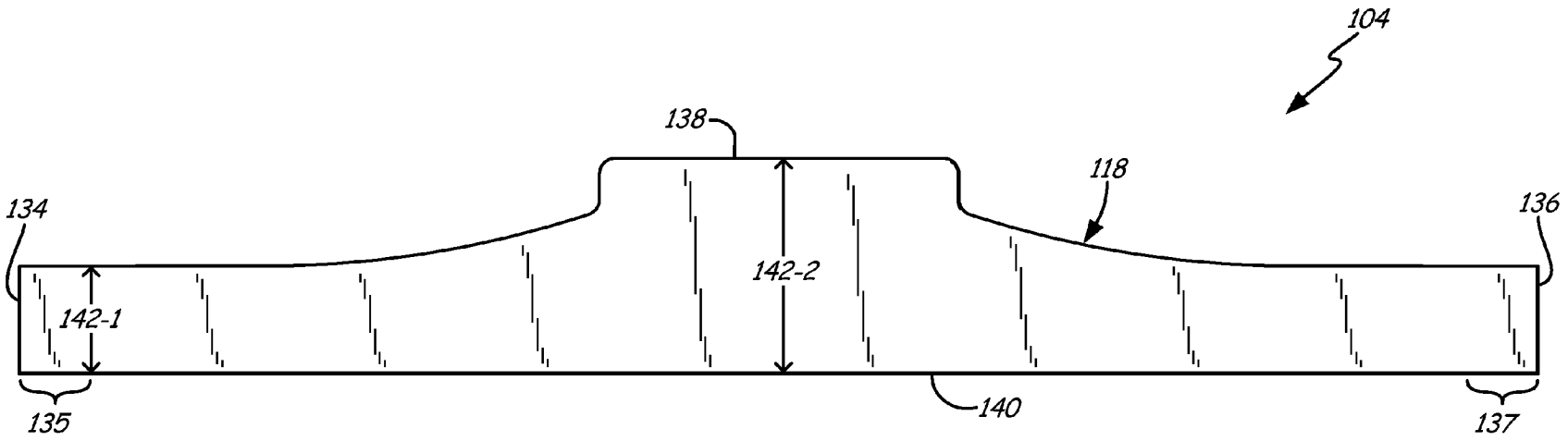
FIG. 10 is a plan view of a band or outer sleeve of the display bin of FIG. 1.

As illustrated in FIG. 10, open top end 138 of band 104 is shaped differently than open bottom end 140 of band 104. In particular, at least a portion of open top end 138 has a non-linear edge, while open bottom end 138 has a substantially linear edge that is substantially orthogonal to side ends 134 and 136. Therefore, a height 142 of band 104 changes along its circumference when the band 104 is assembled into its cylindrical shape. For example, at a minimum point along band 104, the band includes a minimum height 142-1 and at a maximum point along band 104, the band includes a maximum height 142-2. As illustrated, the height of band at any point along its circumference may be any value that is between minimum height 142-1 and maximum height 142-2. In other embodiments, top end 138 can have a linear edge that resides in a single plane that is substantially orthogonal to side ends 134 and 136. In such an embodiment, band 104 has a single height that is constant along its circumference.

The shape and height of band 104 exposes a portion of tubular body 102, which extends above open top end 138 of band 104. The transparency of tubular body 102 allows customers in a retail store to see through the exposed sides of tubular body 102 to view products (not shown) that are on display in display bin 100.

As is the case with tubular body 102 and band 104, the components of multi-part bottom assembly 106 are also shipped to the retail store in a flattened state. In particular, annular structure 120 is shipped to the retail store in a sheet material form such as that illustrated in FIG. 11 and insert 122 is shipped to the retail store in a sheet material form such as that illustrated in FIG. 12.

Figure 11:
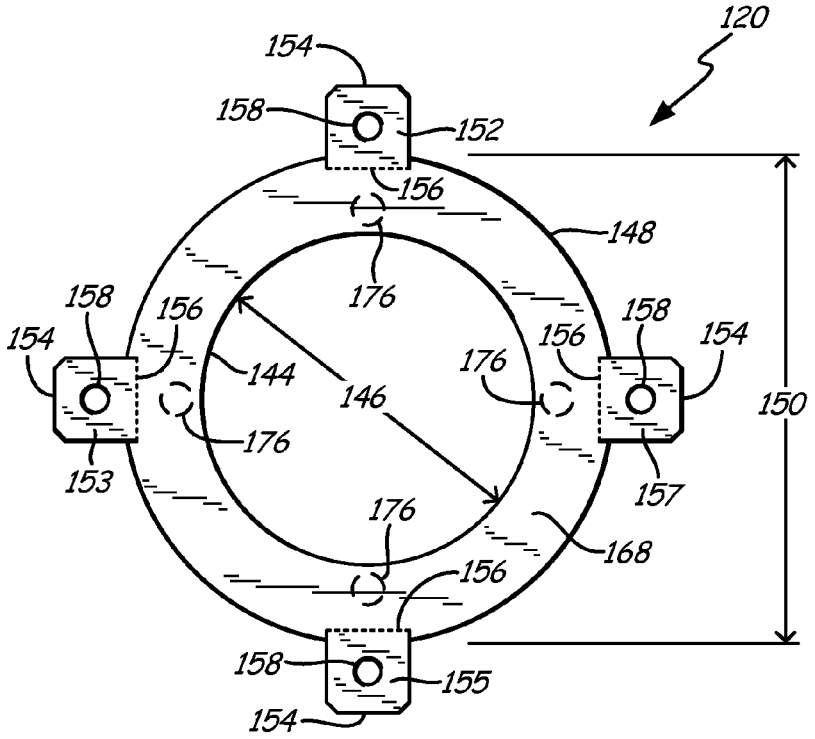
FIG. 11 is a plan view of a first portion of a multi-part bottom of the display bin of FIG. 1.

FIG. 11 illustrates a plan view of annular structure or ring-shaped disk 120 of multi-part bottom assembly 106. Annular structure 120 is made of a sheet material, such as a corrugated cardboard and includes an inner edge 144 that defines an inner diameter 146 of annular structure 120 and an outer edge 148 that defines an outer diameter 150 of annular structure 120. Annular structure 120 also includes a plurality of wings or tabs 152, 153, 155 and 157 that project outwardly from outer edge 148 and terminate at distal ends 154. The plurality of wings 152, 153, 155 and 157 are evenly spaced apart from each other with first wing 152 located opposite of third wing 153 and second wing 153 located opposite fourth wing 157.

Each of the plurality of wings 152, 153, 155 and 157 includes a bend line 156 and an aperture 158. Bend lines 156 are located inwardly from outer edge 148, but outwardly from inner edge 144 of annular structure 120. Bend lines 156 provide the plurality of wings with the ability to be bent so as to orient distal ends 154 in a substantially upward direction.

Figure 12:
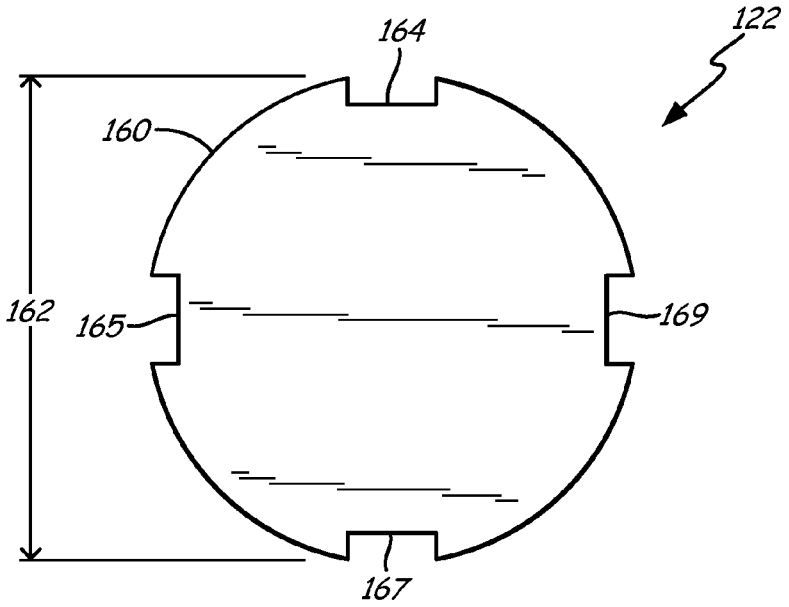
FIG. 12 is a plan view of a second portion of the multi-part bottom of the display bin of FIG. 1.

FIG. 12 illustrates a plan view of insert 122 of multi-part bottom assembly 106. Insert 122 includes an outer edge 160 that defines an insert diameter 162. Insert diameter 162 is greater than inner diameter 146 of annular structure 120. As also illustrated in FIG. 12, insert 122 includes a plurality of notches 164, 165, 167 and 169. Notches 164, 165, 167 and 169 are evenly spaced apart from each other around a circumference of insert 122 with first notch 164 located opposite third notch 167 and second notch 165 located opposite fourth notch 169.

Figure 13:
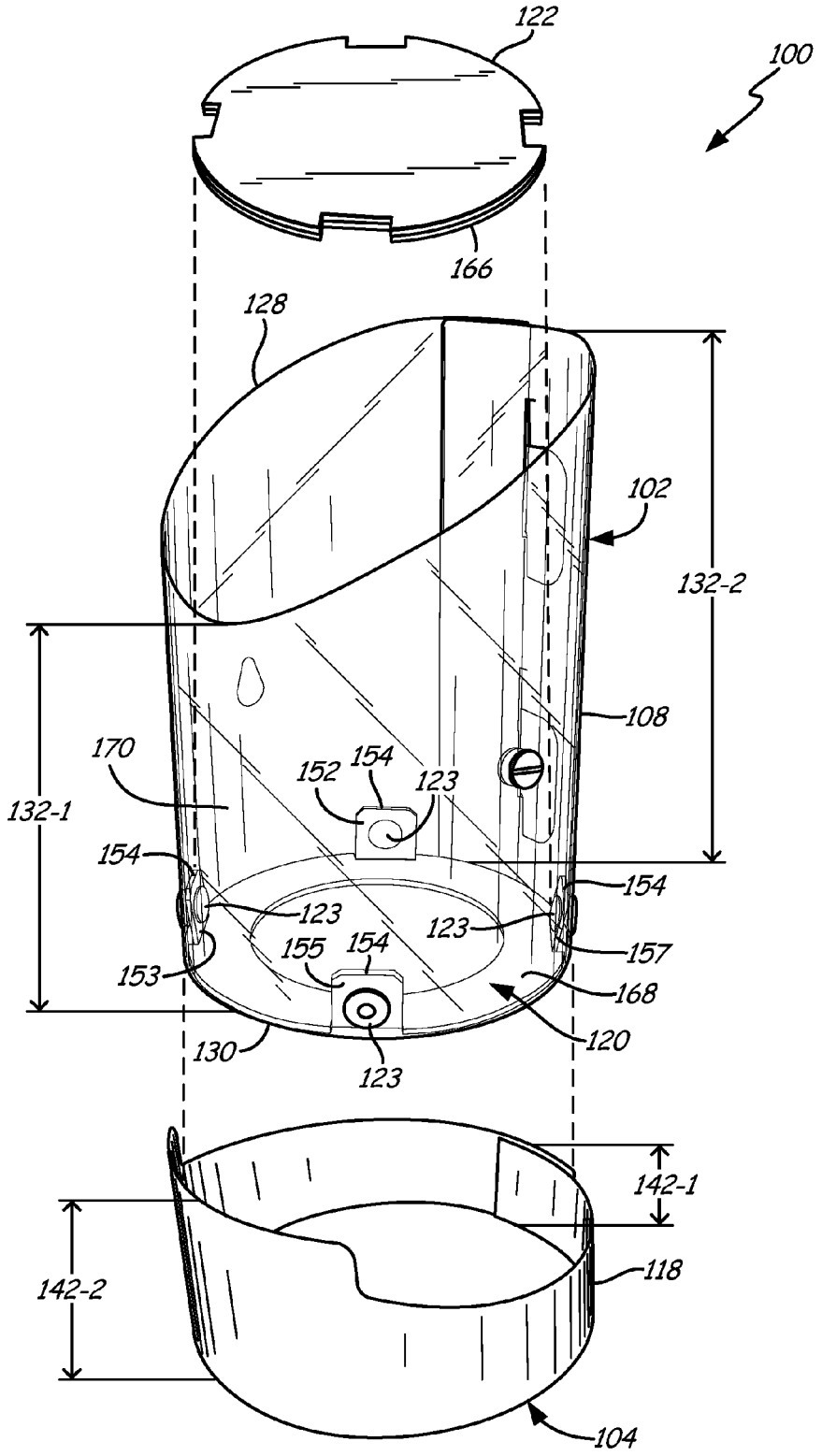
FIG. 13 is an exploded perspective view of the display bin of FIG. 1.

Annular structure 120 is configured to or is capable of being inserted through open bottom end 130 of assembled tubular body 102 to form a portion of multi-part bottom assembly 106 and to close a bottom of the display bin 100 that is otherwise open. In particular, the plurality of fasteners or rivets 123 of multi-part bottom assembly 106, which are best illustrated in the exploded view of FIG. 13, are made of plastic and are configured to couple each of the plurality of wings 152, 153, 155 and 157 of annular structure 120 to transparent tubular body 102. In particular, each fastener is inserted through an aperture 158 extending through one of the bent plurality of wings 152, 153, 155 and 157 of annular structure 120 and through one of base openings 112 in tubular body 102 that is located proximal to bottom end 130. In other words, an aperture 158 extending through each of the bent plurality of wings 152, 153, 155 and 157 and base openings 112 in tubular body 102 receive a fastener or rivet 123.

Insert 122 is configured to or is capable of being inserted through open top end 128 of tubular body 102. Upon insertion, insert 122 is pushed to the bottom of tubular body 102 so that a bottom surface 166 (FIGS. 5 and 13) of insert 122 contacts a top surface 168 (FIGS. 11 and 13) of annular structure 120. Upon contacting bottom surface 166 of insert 122 with top surface 168 of annular structure 120, each of the plurality of notches of insert 122 are mated with each of the plurality of bent wings that project from annular structure 120. In particular, first notch 164 can mate with first wing 152, second notch 165 can mate with second wing 153, third notch 167 can mate with third wing 155 and fourth notch 169 can mate with fourth wing 157. Such a configuration of annular structure 120 and insert 122 acts to close the bottom of display bin 100 and provide a double layer corrugated bottom for added structural integrity.

Still further, multi-part bottom assembly 106 includes a plurality of bumpers 172 (FIGS. 5 and 8) that are coupled to a bottom surface 174 of annular structure 102 by, for example but not limited to, adhesive. Bumpers 172 are coupled to bottom surface 174 of annular structure 102 during manufacture so that when display bin 100 is shipped to a store, bumpers 172 are already applied to annular structure 102. Bumpers 172 are designed to provide surfaces on display bin 100 for resting on a support structure, such as a display shelf, and for supporting tubular body 102 and multi-part bottom assembly 106.

Figure 5:
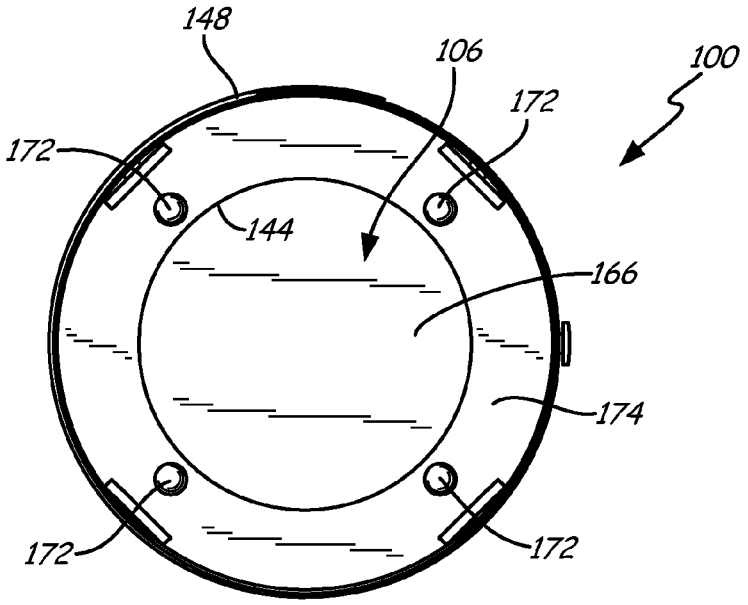
FIG. 5 is a bottom view of the display bin of FIG. 1.
Figure 6:
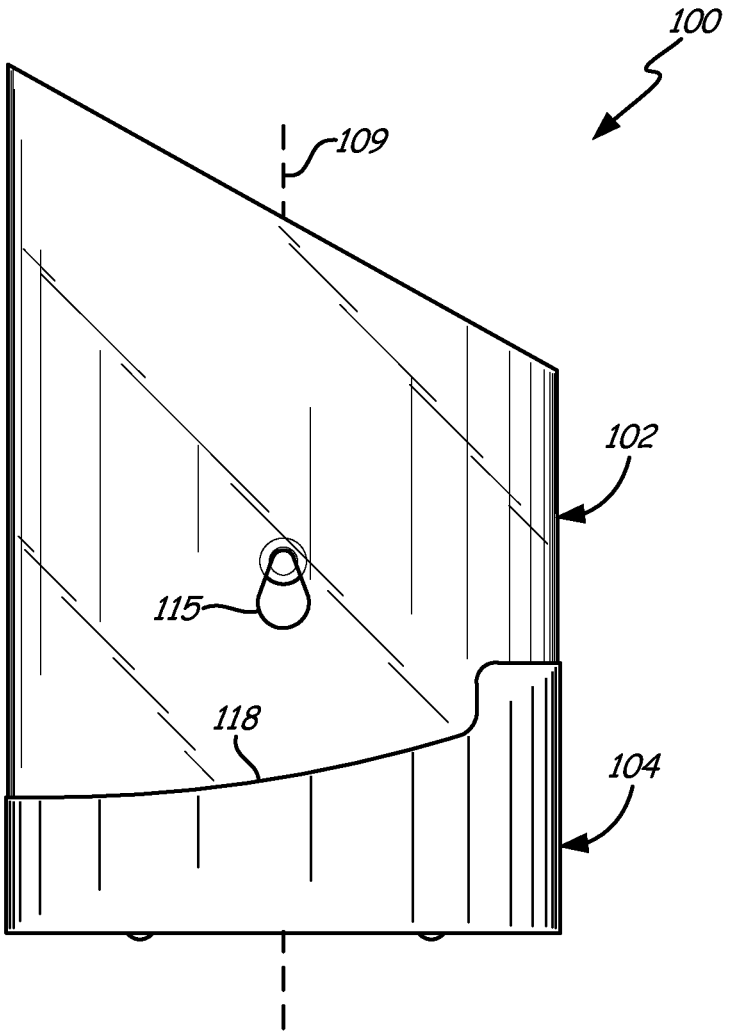
FIG. 6 is a left side view of the display bin of FIG. 1.
Figure 7:
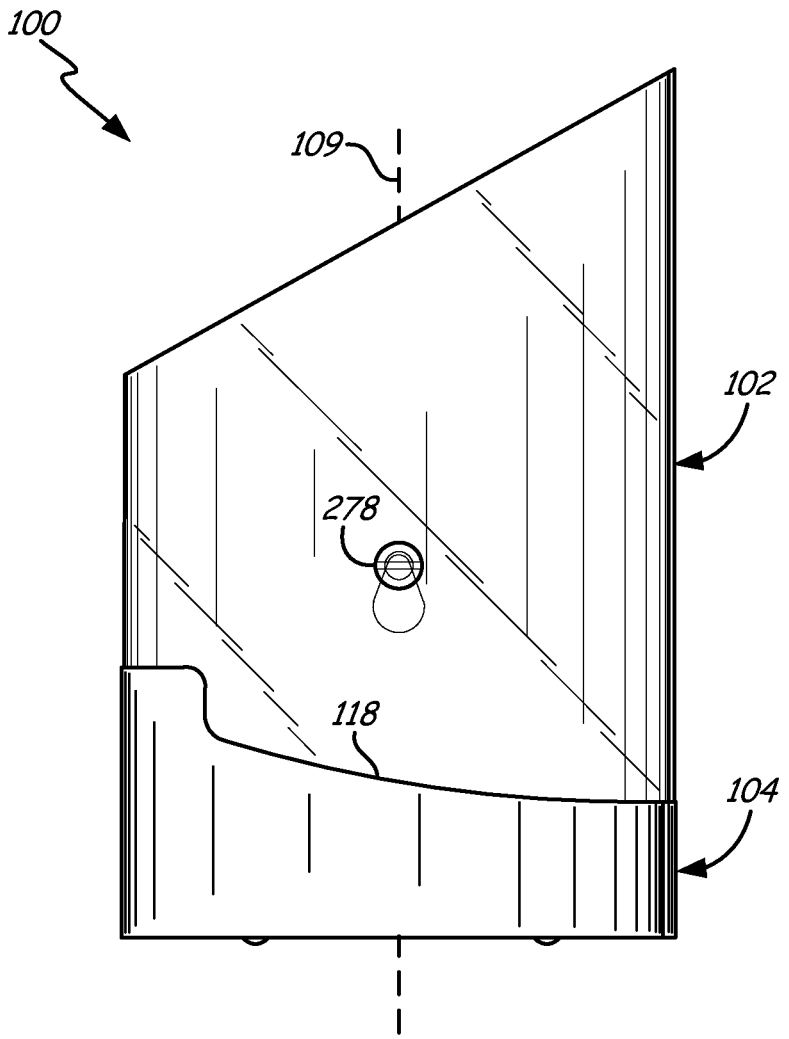
FIG. 7 is a right side view of the display bin of FIG. 1.

As illustrated in FIG. 5, the plurality of bumpers 172 are evenly spaced apart from each other. In particular, annular structure 120 includes four evenly spaced bumpers 172 located around bottom surface 174 of annular structure 120 between inner edge 144 and outer edge 148.

Top surface 168 of annular structure 120 includes a plurality of circular-shaped scores 176. Circular-shaped scores 176 are also located on bottom surface 174 of annular structure 120 although not visible in FIG. 5 because of bumpers 172. Circular-shaped scores 176 are markers for where bumpers 172 should be located on annular structure 120 when being coupled to annular structure 120 during manufacture.

Still further and as previously discussed, band 104 is configured to or is capable of surrounding an outer or exterior surface 170 (FIG. 13) of tubular body 102. In particular, bottom end or edge 140 is placed in alignment with the open bottom end 130 of tubular body. As illustrated in FIGS. 1-8, regardless of whether the height 142 of band 104 is measured at the minimum height 142-1 or at the maximum height 142-2, the height of band 104 is always less than the height 132 of tubular body. In other words, regardless of whether the height 132 of tubular body 104 is measured at the minimum height 132-1 or the maximum height 132-2, the height of tubular body 102 is always greater than the height 142 of band 104.

To erect display bin 100 at a retail store from the flattened form from which it was shipped to an erected form, tubular body 102 is converted from a flat sheet material to a cylinder by rolling transparent plastic sheet material 108, overlapping regions 125 and 127 and securing together opposing side ends 124 and 126 by mating hooked tabs 116 with slits 110. When assembled, tubular body 102 forms a cylindrical shape that has top end or top open end 128 and bottom end or bottom open end 130.

The plurality of wings 152, 153, 155 and 157 of annular structure or ring-shaped disk 120 are folded along their bend lines 156 so that distal ends 154 are oriented or facing substantially in an upwards direction. Annular structure 120 is placed through open bottom end 130 of tubular body 102 and each of the plurality of wings 152, 153, 155 and 157 are attached to the tubular body 102 by inserting a fastener 123 through an aperture 158 in each wing 152, 153, 155 and 157 and through each opening 112 located proximal to bottom open end 130 of tubular body 102. To complete the construction, insert 122 is inserted through top end 128 of tubular body 102 so as to mate the insert 122 with top surface 168 of annular structure 120 including mating the plurality of notches 164, 165, 167 and 169 with the plurality of wings 152, 153, 155 and 157 as illustrated in FIGS. 1-8 to close the bottom of display bin 100.

To further erect display bin 100, band or outer sleeve 104 is converted from a flat sheet material to its cylindrical form by rolling the fibrous opaque sheet material 118, overlapping regions 135 and 137, securing together opposing side ends 134 and 136 using adhesive and sliding the constructed band 104 over the outer surface 170 of tubular body 102 along axis 109. Band 104 is placed along tubular body 102 such that bottom edge 140 of band 104 is in alignment with bottom edge 130 of tubular body 102.

Figure 14:
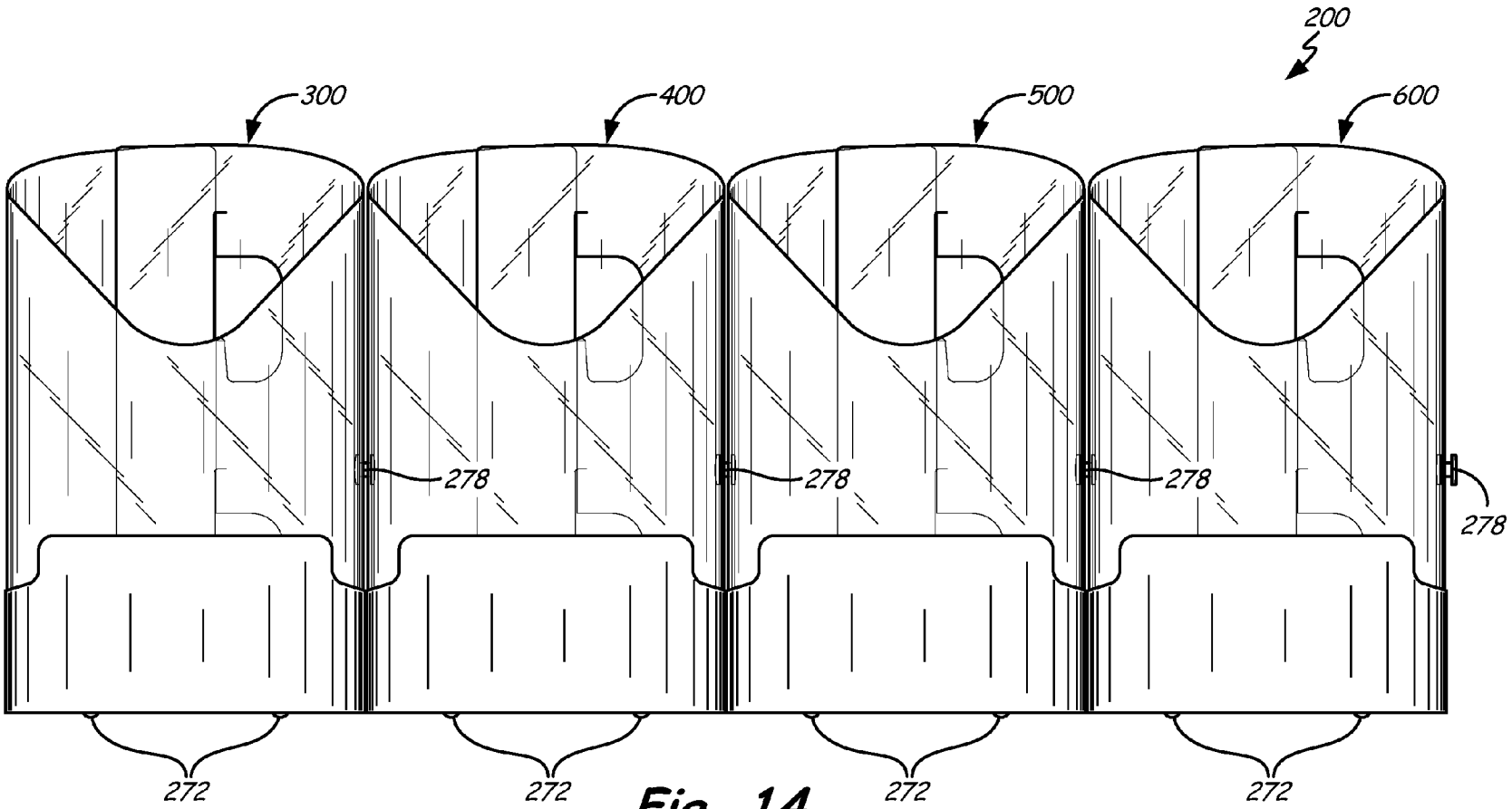
FIG. 14 is a front view of a plurality of display bins assembled together according to another embodiment.
Figure 15:
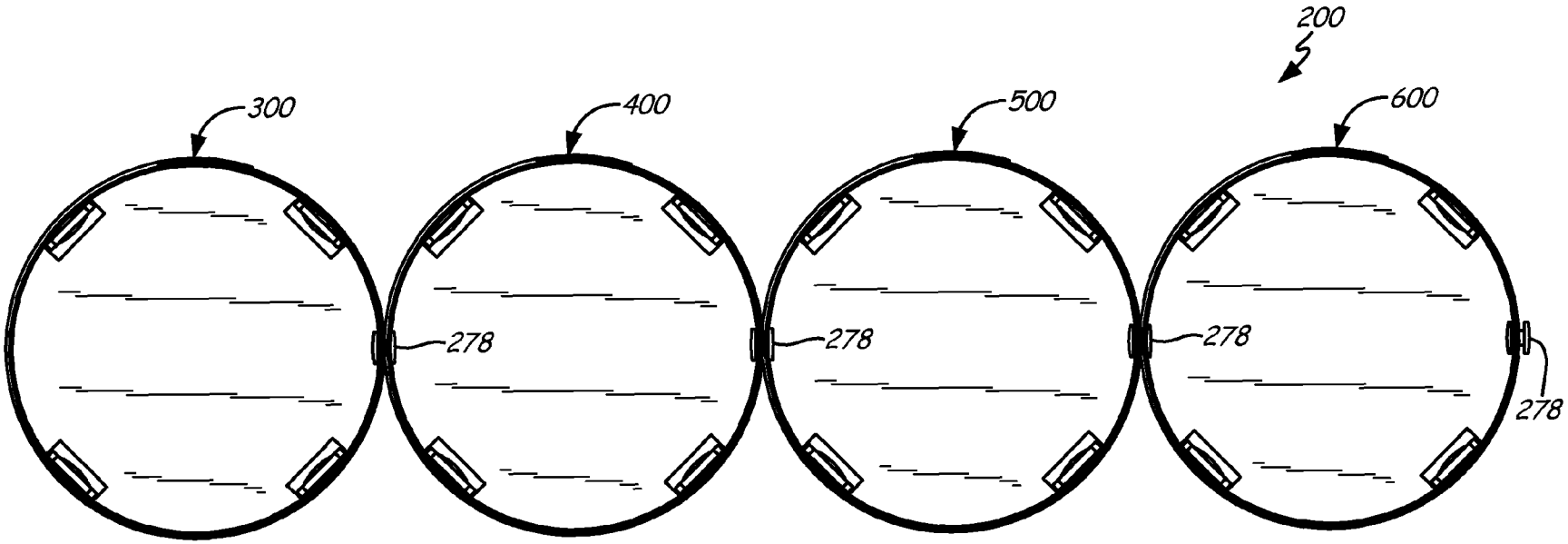
FIG. 15 is a top view of the plurality of assembled display bins of FIG. 14.

In a further embodiment and as illustrated in the front view and top views in FIGS. 14 and 15, a plurality of display bins 300, 400, 500 and 600, each being the substantially similar to display bin 100 described above, are coupled together to form a display unit 200. As illustrated in FIGS. 14 and 15, the four erected display bins 300, 400, 500 and 600 are coupled together side-by-side to form display unit 200. In this embodiment, display bins 300, 400, 500 and 600 are placed adjacent to one another and fastened together using a plurality of fasteners or push locks. For example, display bin 300 is the left-most display bin in display unit 200 and is connected to display bin 400 (the display bin located on the right side of display bin 300) by a fastener 278 that passes through a right side opening 114 in display bin 300 and a left side opening 115 in display bin 400. Besides being coupled to display bin 300 on its left side, display bin 400 is also coupled to display bin 500 located on its right side by a fastener 278 that passes through a right side opening 114 in display bin 400 and a left side opening 115 in display bin 500. Besides being coupled to display bin 400 in its left side, display bin 500 is also coupled to display bin 600 located on its right side by a fastener 278 that passes through a right side opening 114 in display bin 500 and a left side opening 115 in display bin 600. Right-most display bin 600 also includes a fastener 278 in its right side opening 114 for connection to yet another display bin if so desired.

Each of display bins 300, 400, 500 and 600 includes bumpers 272 coupled to a bottom surface of the multi-part bottom assembly of each bin. Bumpers 272 provide surfaces of display unit 200 that rest on a display shelf.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A retail display unit comprising:

a transparent sheet material formed into a tubular body having an open base end and an open top end, the transparent sheet material having a plurality of base openings located proximal to the open base end and spaced apart from each other;

a multi-part bottom assembly comprising:

an annular structure having an inner edge, an outer edge and a plurality of evenly spaced wings projecting outwardly from the outer edge and terminating at distal ends, wherein the annular structure is inserted through the open base end of the tubular body, and a plurality of fasteners coupling each of the plurality of wings of the annular structure to the open base end of the tubular body, wherein each fastener is inserted through one of the plurality of spaced apart base openings; and a band surrounding an outer surface of the tubular body and including a bottom edge placed in alignment with and adjacent to the open base end of the tubular body and a top edge, wherein a height of the band is less than a height of the tubular body; and an insert capable of being inserted through the open top end of the tubular body, wherein a bottom surface of the insert is configured to contact a top surface of the annular structure.

2. The retail display unit of claim 1, wherein the band surrounding the outer surface of the tubular body comprises a fibrous opaque sheet material.

3. The retail display unit of claim 1, wherein the plurality of wings of the annular structure are bent along bend lines such that the distal end of each wing faces in a substantially upward direction.

4. The retail display unit of claim 3, wherein each of the plurality of wings comprises an opening through which each of the plurality of wings receives one of the plurality of fasteners.

5. The retail display unit of claim 1, wherein:

each of the plurality of wings comprises an opening though which each of the plurality of wings receives one of the plurality of fasteners, and the annular structure extends upwardly from the open base end of the tubular body to substantially conceal the plurality of wings and the plurality of fasteners from view through the tubular body.

6. A retail display unit comprising:

a transparent sheet material formed into a tubular body having an open base end and an open top end, the transparent sheet material having a plurality of base openings located proximal to the open base end and spaced apart from each other;

a multi-part bottom assembly comprising:

an annular structure having an inner edge, an outer edge and a plurality of evenly spaced wings projecting outwardly from the outer edge and terminating at distal ends, wherein the annular structure is inserted through the open base end of the tubular body, and a plurality of fasteners coupling each of the plurality of wings of the annular structure to the base end of the tubular body, wherein each fastener is inserted through one of the plurality of spaced apart base opening; and an insert capable of being inserted through the open top end of the tubular body, wherein a bottom surface of the insert is configured to contact a top surface of the annular structure, and the insert comprises a plurality of notches mated with the plurality of wings that are coupled to the tubular body.

7. The retail display unit of claim 6, wherein the insert is a single planar member, and outermost edges of the insert directly abut and terminate at an internal surface of the tubular body.

8. The retail display unit of claim 7, wherein the annular structure is a single piece member having the wings folded upwardly from a remainder of the annular structure to receive a corresponding one of the plurality of fasteners.

9. The retail display unit of claim 8, wherein the annular structure defines a bottom planar surface positioned substantially coplanar with the open base end of the tubular body.

10. A display bin comprising:

a transparent inner sleeve made of plastic sheet material and having an open top end and an open bottom end, the transparent inner sleeve having a plurality of bottom openings located adjacent to the open bottom;

a ring-shaped disk made of fibrous sheet material including an outer diameter and an inner diameter, wherein the ring-shaped disk is configured to be inserted through the open bottom end of the transparent inner sleeve and includes a plurality of tabs projecting outwardly from the outer diameter of the ring-shaped disk and terminating at distal ends;

a plurality of fasteners coupling the ring-shaped disk to the plurality of bottom openings in the transparent inner sleeve; an outer sleeve made of fibrous sheet material that surrounds an outer surface of the ring-shaped disk and includes a bottom edge placed in alignment with the open bottom end of the transparent inner sleeve and a top edge, wherein a height of the outer sleeve is less than a height of the transparent inner sleeve; and an insert comprising a plurality of notches for mating with the plurality of tabs that are coupled to the transparent inner sleeve.

11. The display bin of claim 10, wherein each of the plurality of tabs of the ring-shaped disk are bent along bend lines such that the distal end of each tab faces in a substantially upward direction.

12. The display bin of claim 10, wherein each of the plurality of tabs comprises an opening through which one of the plurality of fasteners is received for coupling to one of the bottom openings of the transparent inner sleeve.

13. The display bin of claim 10, wherein the insert is capable of being inserted through the open top end of the transparent inner sleeve, wherein a bottom surface of the insert is configured to contact a top surface of the ring-shaped disk.

* * * * *